US006578889B2

(12) United States Patent
Pearl

(10) Patent No.: US 6,578,889 B2
(45) **Date of Patent: *Jun. 17, 2003**

(54) FORGED TRENCH PLATE CONNECTOR

(76) Inventor: Fred R. Pearl, 5402 Yale Ave., Westminster, CA (US) 92683-3418

( * ) Notice: Subject to any disclaimer, the term of this patent is extended or adjusted under 35 U.S.C. 154(b) by 0 days.

This patent is subject to a terminal disclaimer.

(21) Appl. No.: 09/957,528

(22) Filed: Sep. 19, 2001

(65) Prior Publication Data

US 2002/0014569 A1 Feb. 7, 2002

Related U.S. Application Data

(63) Continuation-in-part of application No. 09/108,573, filed on Jul. 1, 1998.

(60) Provisional application No. 60/056,161, filed on Aug. 19, 1997.

(51) Int. Cl.[7] ..... A47F 13/06

(52) U.S. Cl. ..... 294/1.1; 248/499; 403/164; 410/101; 411/489

(58) Field of Search ..... 248/499, 500, 248/505; 411/489, 389; 294/1.1; 24/115 K; 403/119, 164, 60; 410/101

(56) References Cited

U.S. PATENT DOCUMENTS 3,297,293 A * 1/1967 Andrews et al. ..... 248/499
3,905,633 A * 9/1975 Larson ..... 248/499 X
4,431,352 A * 2/1984 Andrews ..... 410/401
4,705,422 A * 11/1987 Tsui et al. ..... 403/60
5,586,801 A * 12/1996 Sawyer et al. ..... 294/1.1
5,772,252 A * 6/1998 Malani ..... 411/389 X
6,161,883 A * 12/2000 Pearl ..... 294/1.1
6,161,884 A * 12/2000 Pearl ..... 294/1.1

* cited by examiner

*Primary Examiner*—Ramon O. Ramirez
(74) *Attorney, Agent, or Firm*—Stout, Uxa, Buyan & Mullins, LLP

(57) ABSTRACT

A forged trench plate connector having a forged steel unitary eye member and a large-diameter skirt member for dissipating lateral forces, applied onto the trench plate connector, is disclosed. The large-diameter skirt member is threaded onto a double-threaded stud used to accommodate the large-diameter skirt member. The double-threaded stud comprises a first thread on one end for being threaded into a trench plate, and a second thread on the other end for accommodating both the large-diameter skirt member and a securing nut. Once the large-diameter skirt member is locked into place, one or more arms of the large-diameter skirt member can be used to apply rotational forces onto the trench plate connector to thereby secure or remove the stud of the trench plate connector from the trench plate.

20 Claims, 4 Drawing Sheets

FORGED TRENCH PLATE CONNECTOR

This application is a continuation-in-part of U.S. application Ser. No. 09/108,573, filed on Jul. 1, 1998 and entitled TRENCH PLATE CONNECTOR which claims the benefit of U.S. Provisional Application Ser. No. 60/056,161, filed Aug. 19, 1997, the contents of which are expressly incorporated herein by reference.

BACKGROUND OF THE INVENTION

1. Field of the Invention

The present invention relates generally to fastening devices and, more particularly, to a swivel hoist ring for being removably connected to trench plates.

2. Description of Related Art

Various swivel hoist rings have been implemented in the prior art. U.S. Pat. No. 3,297,293 to Andrews et al. discloses a fastening device comprising an eye member which is pivotally and rotationally mounted onto a base. The fastening device, however, comprises a relatively small-diameter retaining ring for contacting the base. Horizontal forces exerted onto the fastening device must thus be absorbed by a stud secured into the base and the relatively small-diameter retaining ring. Additionally, removal of the fastening device from the base can only be achieved by using a tool to grip the head of the stud, which is also configured to have a relatively small diameter. If the head of the stud is damaged, or if a wrench is not available for fitting onto the head of the stud, then the fastening device cannot easily be removed.

Trench plates generally comprise rectangular steel members weighing between 5,000 and 9,000 pounds. A typical trench plate may be 8 feet wide by 12 feet long and 2 inches thick. A threaded nut is secured in a middle area of the trench plate, and is adapted for receiving an eye bolt, according to the prior art. The eye bolt comprises an opening, for receiving a cable or other fastening member. Once the eye bolt is threaded into the nut of the trench plate, and is fastened to a cable, for example, the trench plate can be removed. Eye bolts, however, are incapable of swiveling and maintaining structural integrity under off-axis horizontal loads.

SUMMARY OF THE INVENTION

The forged trench plate connector of the present invention comprises a forged steel unitary eye member and a large-diameter skirt member for dissipating lateral forces applied onto the trench plate connector. The large-diameter skirt member is threaded onto a stud, and can be locked onto the stud with a nut. Once the large-diameter skirt member is locked into place, one or more arms of the large-diameter skirt member can be used to apply rotational forces onto the trench plate connector to thereby secure or remove the stud of the trench plate connector from the trench plate. Each arm of the large-diameter skirt member can be impacted with a hammer, for example, to apply substantial rotational forces onto the trench plate connector for tightening or removal thereof. A unique double-threaded stud is used to accommodate the large-diameter skirt member of the present invention. The double-threaded stud comprises a first thread on one end for being threaded into a trench plate, and a second thread on the other end for accommodating both the large-diameter skirt member and a securing nut.

The present invention, together with additional features and advantages thereof, may best be understood by reference to the following description taken in connection with the accompanying illustrative drawings.

DETAILED DESCRIPTION OF THE PRESENTLY PREFERRED EMBODIMENT

Figure 1:
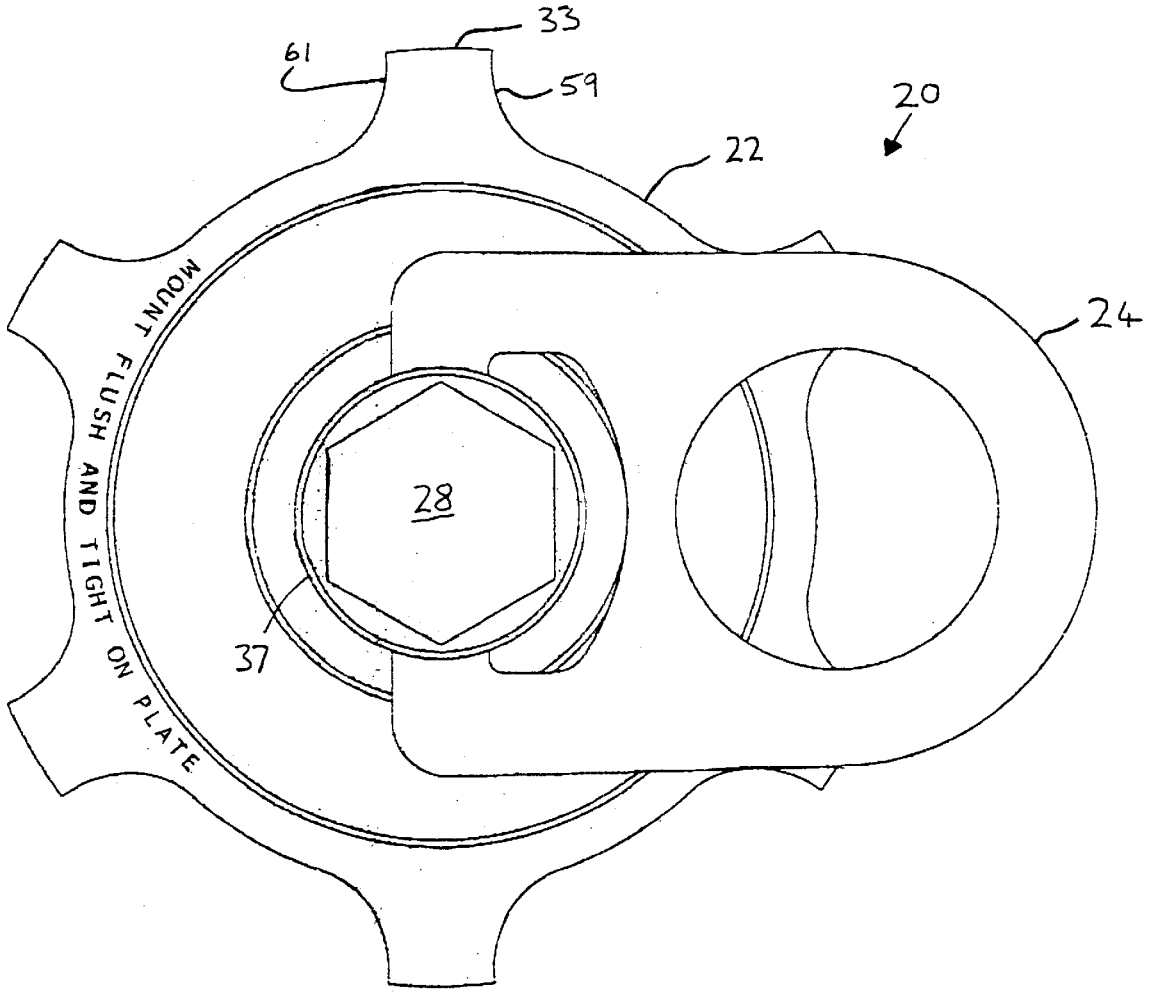
FIG. 1 illustrates a top-planar view of a forged trench plate connector in accordance with the present invention.

Referring more particularly to the drawings, FIG. 1 illustrates a forged trench plate connector 20 comprising a large-diameter skirt member 22, an integral or unitary eye member 24, a double-threaded stud 26 (FIG. 3) and a nut 28. The nut 28 comprises a threaded cylindrical portion for receipt of the double-threaded stud 26 and a nut head. The nut head may include a threaded bore extending from the cylindrical portion of the nut entirely through the nut head, for receipt of the double-threaded stud 26 therethrough. In practice, the double-threaded stud 26 and nut 28 may be welded together at the exposed top of the nut bore. The large-diameter skirt member 22 comprises a number of arms 33 and a threaded aperture 52 (FIG. 3) for accommodating the double-threaded stud 26. The large-diameter skirt member 22 is preferably manufactured to have a diameter of approximately nine inches, and each of the arms 33 is preferably manufactured to have a width at a distal end of approximately one inch.

The eye member 24 is forged into a unitary structure, having feet 35, 36 the ends of which are inserted into a corresponding aperture in the load ring 37 to thereby mechanically lock the eye member 24 to the load ring 37. (See FIG. 3.) The eye member 24 is shown in FIG. 1 in an off-axis position, relative to an axis of the stud 26. In the configuration of FIG. 1, the eye member 24 is pivoted about an axis formed by the feet 35, 36 of the eye member 24 in a direction toward the right side of the page. In addition to being pivotable about an axis formed by the feet 35, 36 of the eye member 24, the eye member 24 is rotatable about an axis of the double-threaded stud 26 and nut 28. The components described in FIG. 1 are preferably formed of aircraft quality 4140 steel that has been heat treated with a finish comprising oil black oxide. The steel comprising the eye member 24 has been forged to form a unitary structure having a high tensile strength, durability and cost-effective construction. This unitary design does not require the insertion of holes for placement of a locking pin, or any other feature that may weaken or otherwise diminish the overall strength of the eye member. Furthermore, the integral design of the preferred embodiment of the eye member requires no moving parts thereby attenuating the potential for breakage of the eye member and generally rendering damage of the device unlikely.

Figure 2:
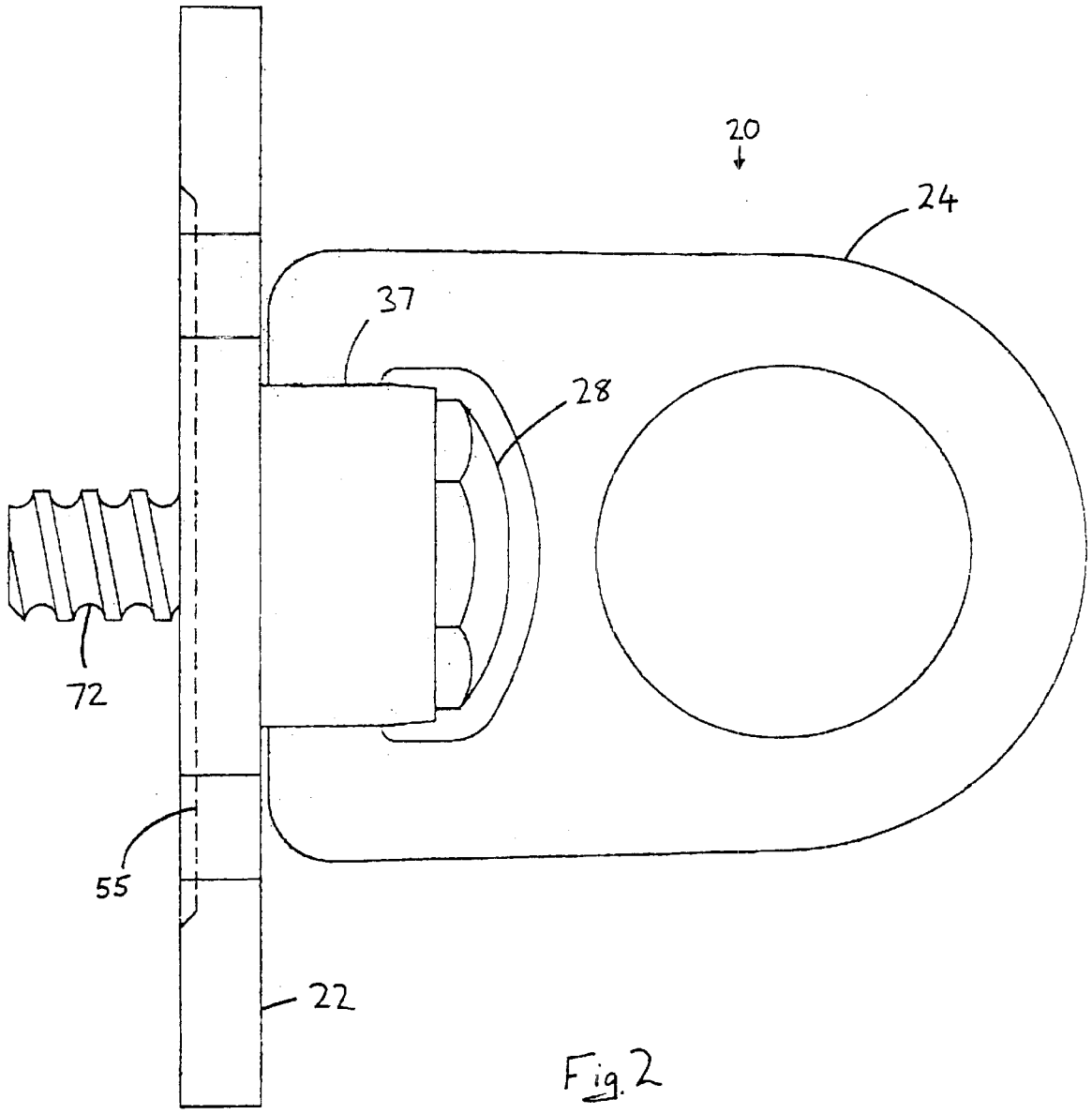
FIG. 2 illustrates a side-elevational view of a forged trench plate connector in accordance with the present invention.

FIG. 2 illustrates a side-elevational view of the trench plate connector 20 of the present invention. A thickness of the large-diameter skirt member 22 may be 0.75 inches, and a thickness of the eye member 24 may be 1.25 inches. An exterior width of the eye member 24 may be 5.4 inches, and an interior width of the eye member 24 can be 3.2 inches. A height of the eye member 24 can be 7.48 inches, and a height of the eye member and the large-diameter skirt member together can be approximately 8.25 inches. The forged trench plate connector preferably comprises a safety factor of 5:1, and a rated load of approximately 15,000 pounds.

The large-diameter skirt member 22 includes a threaded aperture 52 for accommodating the double-threaded stud 26. (See FIG. 3.) A recessed area 55 is formed in the bottom of the large-diameter skirt member 22. The recessed area 55 is adapted to accommodate a portion of a nut of a trench plate, which may protrude slightly from a surface of the trench plate. The recessed area 55 helps to ensure that the entire bottom surface of the large-diameter skirt member 22, with possibly the exception of the recessed area 55, contacts the surface of the trench plate. When the bottom surface of the large-diameter skirt member 22 fits flush against the upper surface of a trench plate, horizontal forces exerted on the eye member 24 and transferred to the double-threaded stud 26 and nut 28, are subsequently transferred from the bottom surface of the large-diameter skirt member 22 onto the upper surface of the trench plate. All of the forces are therefore not concentrated only on the stud 26 and nut 28. Horizontal forces are defined herein as forces which are off-axis to the axis of the double-threaded stud 26 and nut 28.

Another aspect of the present invention is the configuration of the arms 33 of the large-diameter skirt member 22. Each arm 33 comprises two surfaces 59, 61, which are angled approximately radially outwardly from a center of the large-diameter skirt member 22. Each of the surfaces 59, 61 is adapted for receiving a rotational force for either threading the double-threaded stud 26 into a threaded nut of the trench plate or unthreading the double-threaded stud 26 therefrom. A hammer, for example, may be applied onto the surface 61 in order to apply rotational forces thereto. In an alternative embodiment, the arms 33 may be extended radially outwardly in order to accommodate rectangular cross-sectioned pipes, for example.

The double-threaded stud 26 comprises a first portion of threads 72, which are preferably adapted for being threaded into an aperture of the trench plate. The double-threaded stud 26 further comprises a second portion of threads 74, which are adapted for being threaded into both the aperture 52 of the large-diameter skirt member 22 and the nut 28. The large distance of the arms 33 from a center portion of the large-diameter skirt member 22 facilitates the application of high-torque forces onto the large-diameter skirt member 22 and, subsequently, onto the double-threaded stud 26.

Figure 3:
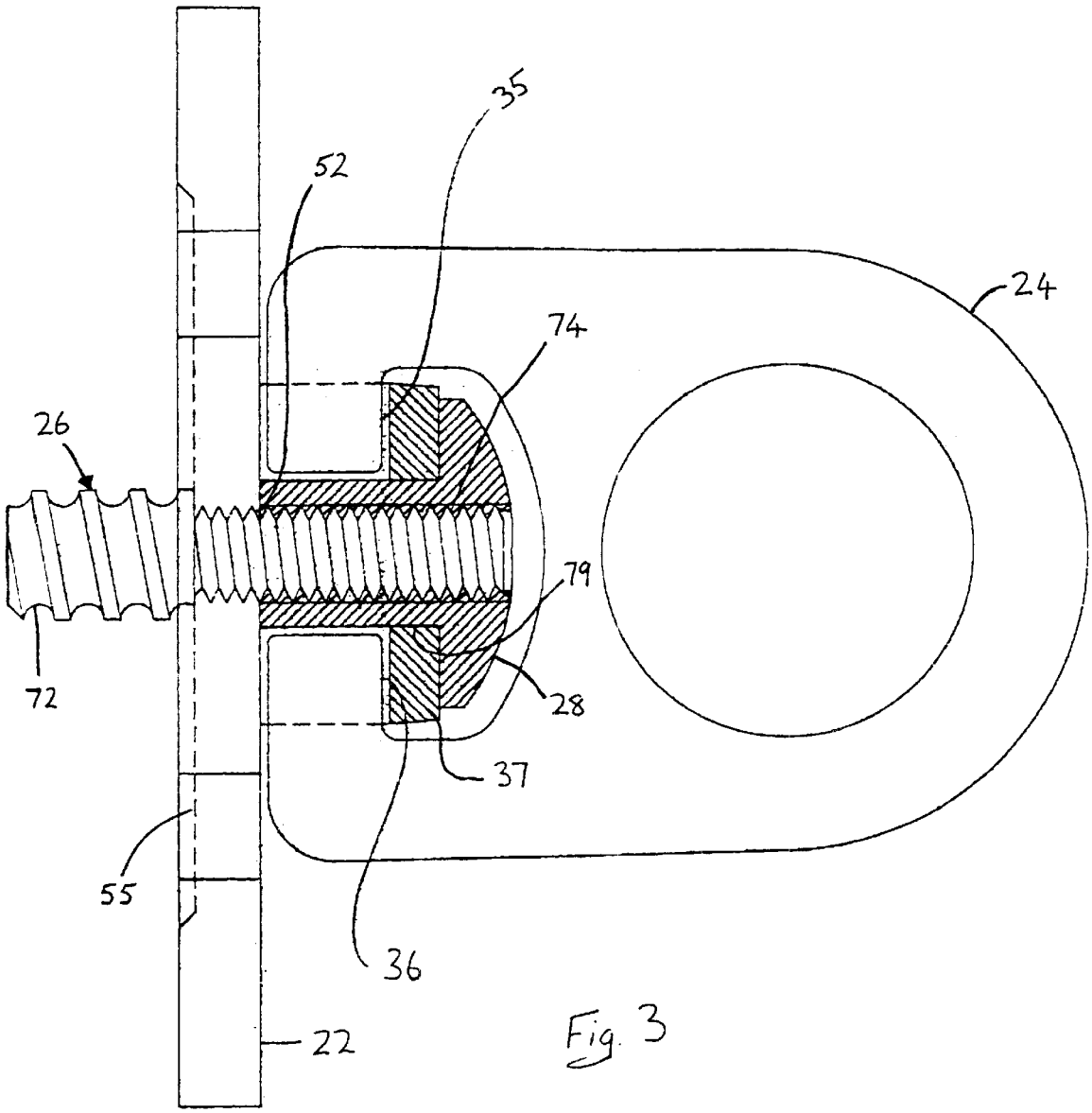
FIG. 3 illustrates a partial cross-sectional view of a forged trench plate connector in accordance with the present invention.
Figure 4:
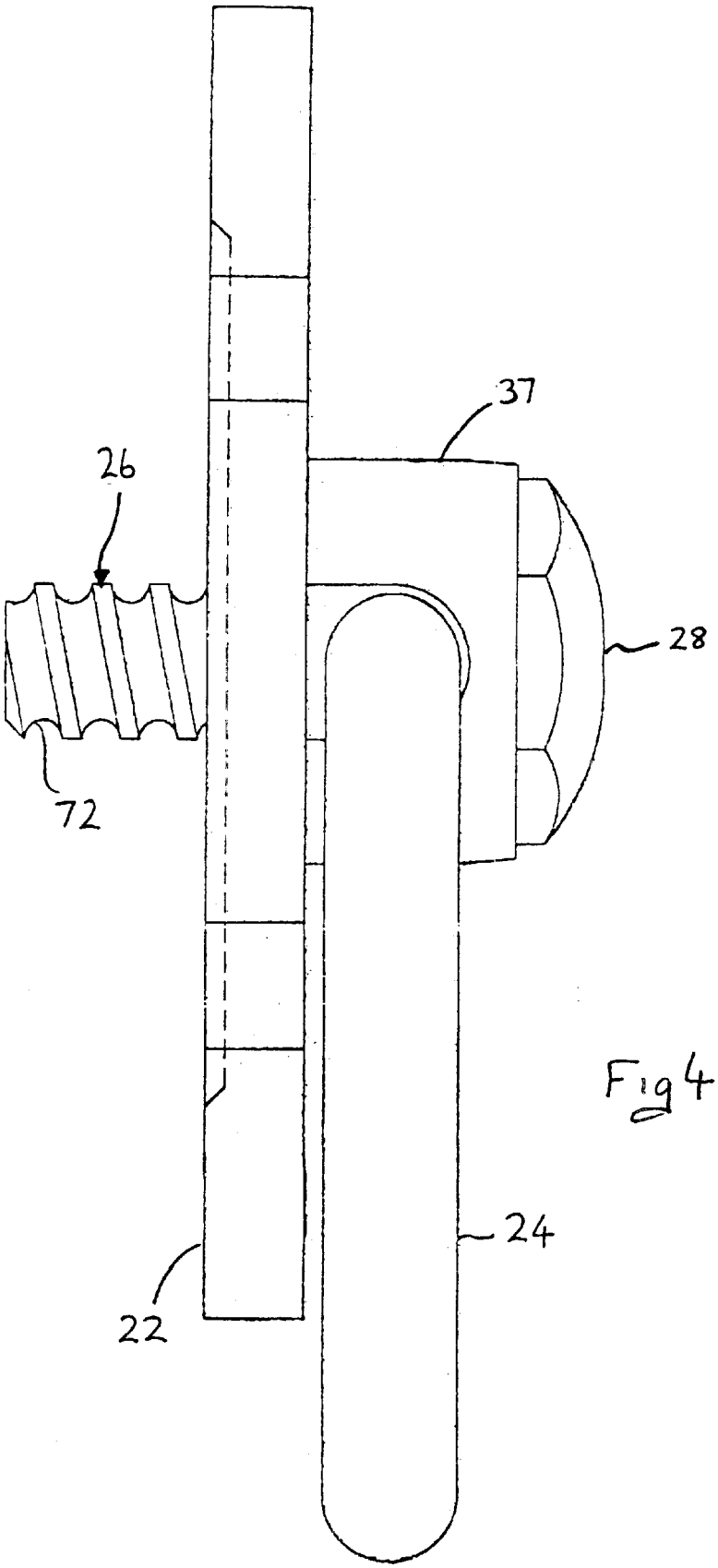
FIG. 4 illustrates a side-elevational view of a forged trench plate connector in accordance with the present invention.

FIG. 3 illustrates a partial cross-sectional view of the trench plate connector 20 of the present invention. Mounted on the double-threaded stud 26 and nut 28 is the load ring 37 having an axial bore 79 for receiving the double-threaded stud 26. The load ring 37 is rotatable about the double-threaded stud 26 and nut 28. The load ring 37 frictionally engages and is in one embodiment seated on a raised portion (not shown) of the large-diameter skirt member 22. The load ring 37 can be freely rotated in either direction for a full 360 degrees about an axis of the double-threaded stud 26 and nut 28. In one embodiment a circular plate is fitted over the double-threaded stud 26 between the head of the nut 28 on one side and the surface of the load ring 37 on the other side.

Each of the feet 35, 36 of the eye member 24 are mechanically engaged to the load ring 37 by insertion into a corresponding aperture in the load ring 37. The vertical bore wherein the feet 35, 36 of the eye member 24 are lockingly engaged with the load ring 37 are closed by the nut 28 and the surface of the large-diameter skirt member 22 to assist in holding the eye member 24 in place and to preclude unintentional loss or disengagement.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A trench plate connector, comprising:

a double threaded stud having a proximal end, a distal end, and a rotational axis extending therebetween, the double-threaded stud comprising a nut at the proximal end, and further comprising a first thread near the proximal end and a second thread near the distal end, the first thread being different in dimension than the second thread;

a load ring disposed around a portion of the double-threaded stud between the proximal end and the distal end;

a unitary eye member comprising forged steel and connected to the load ring; and a skirt member coupled to the double-threaded stud around the first thread, the skirt member comprising a large diameter relative to a width of the eye member measured in a direction perpendicular to the rotational axis.

2. The trench plate connector as recited in claim 1, the unitary eye member having a pair of feet at its ends.

3. The trench plate connector as recited in claim 2, the load ring being formed with a plurality of apertures corresponding to the feet of the eye member for mechanical connection thereto.

4. The trench plate connector as recited in claim 2, the unitary eye member consisting of forged steel.

5. The trench plate connector as recited in claim 1, the second thread being coarser than the first thread and having a greater pitch than the first thread.

6. The trench plate connector as recited in claim 1, the skirt member comprising a plurality of arms.

7. The trench plate connector as recited in claim 6, wherein each of the plurality of arms comprises a surface angled approximately radially outwardly from a center of the skirt member.

8. The trench plate connector as recited in claim 1, the unitary eye member consisting of forged steel.

9. A trench plate connector, comprising:

a stud having a proximal end, a distal end, and a rotational axis extending therebetween;

a load ring disposed around a portion of the stud between the proximal end and the distal end;

a unitary eye member comprising forged steel and coupled to the load ring; and a large diameter skirt member coupled to the stud, the large diameter skirt member comprising a large diameter relative to a width of the eye member measured in a direction perpendicular to the rotational axis and comprising at least one radially extending arm having a surface angled approximately radially outwardly from a center of the skirt member.

10. The trench plate connector as recited in claim 9, wherein the stud comprises a double-threaded stud.

11. The trench plate connector as recited in claim 10, wherein at least one radially extending arm extends radially from the rotational axis in a plane which is generally parallel with a plane of the large-diameter skirt member.

12. The trench plate connector as recited in claim 9, the load ring being formed with a plurality of apertures for accommodating a corresponding plurality of feet of the eye member for mechanical connection thereto.

13. The trench plate connector as recited in claim 12, the unitary eye member consisting of forged steel.

14. The trench plate connector as recited in claim 12, wherein the feet of the eye member are disposed near the large diameter skirt member.

15. The trench plate connector as recited in claim 9, further comprising a nut for receipt of the stud.

16. The trench plate connector as recited in claim 15, the nut having a cylindrical body portion and a nut head portion.

17. The trench plate connector as recited in claim 16, the nut head having a bore therethrough for receipt of the stud through the nut.

18. A trench plate connector, comprising:

a stud having a proximal end, a distal end, and a rotational axis extending therebetween;

a load ring disposed around a portion of the stud between the proximal end and the distal end;

a forged-steel unitary eye member coupled to the load ring;

the eye member being formed with a pair of feet at its ends; and a skirt member coupled to the stud, the skirt member comprising at least one arm extending radially therefrom, wherein the skirt member comprises a perimeter that excludes the shape of a hex nut.

19. The trench plate connector as recited in claim 18, the eye member consisting of forged steel and the skirt member comprising machined steel.

20. The trench plate connector as recited in claim 18, the stud comprising a double-threaded stud.

* * * * *